US011066140B1

(12) United States Patent
Huffer et al.

(10) Patent No.: US 11,066,140 B1
(45) Date of Patent: Jul. 20, 2021

(54) OUTBOARD MOTORS HAVING RESILIENT MOUNTING APPARATUSES

(71) Applicant: Brunswick Corporation, Mettawa, IL (US)

(72) Inventors: Colin M. Huffer, Oshkosh, WI (US); Donald Anderson, Jr., Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 3 days.

(21) Appl. No.: 16/713,107

(22) Filed: Dec. 13, 2019

(51) Int. Cl.
*B63H 20/06* (2006.01)
*B63H 20/18* (2006.01)
*B63H 20/12* (2006.01)

(52) U.S. Cl.
CPC ..... *B63H 20/06* (2013.01); *B63H 20/12* (2013.01); *B63H 20/18* (2013.01)

(58) Field of Classification Search
CPC ..... B63H 20/06; B63H 20/12; B63H 20/18
See application file for complete search history.

(56) References Cited

U.S. PATENT DOCUMENTS

| | | | | |
|---|---|---|---|---|
| 1,451,452 | A | 4/1923 | Totten | |
| 4,521,201 | A | 6/1985 | Watanabe | |
| 4,701,141 | A | 10/1987 | Sumigawa | |
| 5,180,319 | A * | 1/1993 | Shiomi | B63H 21/305 248/640 |
| 7,244,152 | B1 | 7/2007 | Uppgard | |
| 7,303,595 | B1 | 12/2007 | Janitz | |
| 7,896,304 | B1 | 3/2011 | Eichinger et al. | |
| 8,820,701 | B1 | 9/2014 | Eichinger | |
| 9,205,906 | B1 | 12/2015 | Eichinger | |
| 9,376,191 | B1 | 6/2016 | Jaszewski | |
| 9,463,859 | B1 | 10/2016 | Cooper, III et al. | |
| 9,481,434 | B1 | 11/2016 | Eichinger et al. | |
| 9,643,703 | B1 | 5/2017 | Eichinger | |
| 9,701,383 | B1 | 7/2017 | Stuber et al. | |
| 9,764,813 | B1 | 9/2017 | Zarembka et al. | |
| 9,783,278 | B1 | 10/2017 | Dannenberg et al. | |
| 9,789,945 | B1 | 10/2017 | Vaninetti et al. | |
| 9,963,213 | B1 | 5/2018 | Jaszewski et al. | |
| 9,969,475 | B1 | 5/2018 | Waisanen | |
| 10,005,536 | B2 * | 6/2018 | Fukuchi | B63H 21/305 |
| 10,124,871 | B1 | 11/2018 | Eichinger et al. | |
| 10,246,173 | B1 | 4/2019 | Ingebritson | |
| 10,464,648 | B1 | 11/2019 | Amerling et al. | |
| 2009/0170384 | A1 | 7/2009 | Balogh et al. | |

* cited by examiner

*Primary Examiner* — Stephen P Avila
(74) *Attorney, Agent, or Firm* — Andrus Intellectual Property Law, LLP

(57) ABSTRACT

An outboard motor has a powerhead; a driveshaft housing located below the powerhead; a steering arm extending forwardly from the driveshaft housing; a steering tube extending downwardly from the steering arm; an upper mounting device that resiliently mounts the steering arm to the driveshaft housing; and a lower mounting device comprising a yoke that laterally extends from the steering tube. The yoke is clamped to the steering tube and contains port and starboard mounts that resiliently couple the steering tube to the driveshaft housing.

20 Claims, 6 Drawing Sheets

OUTBOARD MOTORS HAVING RESILIENT MOUNTING APPARATUSES

FIELD

The present disclosure relates to outboard motors for propelling a marine vessel in water, and more particularly to mounting apparatuses for resiliently mounting an outboard motor to the marine vessel.

BACKGROUND

The following U.S. Patents are incorporated herein by reference, in entirety.

U.S. Pat. No. 9,205,906 discloses a mounting arrangement for supporting an outboard motor with respect to a marine vessel extending in a fore-aft plane. The mounting arrangement comprises first and second mounts that each have an outer shell, an inner wedge concentrically disposed in the outer shell, and an elastomeric spacer between the outer shell and the inner wedge. Each of the first and second mounts extend along a axial direction, along a vertical direction that is perpendicular to the axial direction, and along a horizontal direction that is perpendicular to the axial direction and perpendicular to the vertical direction. The inner wedges of the first and second mounts both have a non-circular shape when viewed in a cross-section taken perpendicular to the axial direction. The non-circular shape comprises a first outer surface that extends transversely at an angle to the horizontal and vertical directions. The non-circular shape comprises a second outer surface that extends transversely at a different, second angle to the horizontal and vertical directions. A method is for making the mounting arrangement.

U.S. Pat. No. 9,701,383 discloses a marine propulsion support system having a transom bracket, a swivel bracket, and a mounting bracket. A drive unit is connected to the mounting bracket by a plurality of vibration isolation mounts, which are configured to absorb loads on the drive unit that do not exceed a mount design threshold. A bump stop located between the swivel bracket and the drive unit limits deflection of the drive unit caused by loads that exceed the threshold. An outboard motor includes a transom bracket, a swivel bracket, a cradle, and a drive unit supported between first and second opposite arms of the cradle. First and second vibration isolation mounts connect the first and second cradle arms to the drive unit, respectively. An upper motion-limiting bump stop is located remotely from the vibration isolation mounts and between the swivel bracket and the drive unit.

U.S. Pat. No. 9,764,813 discloses a tiller for an outboard motor. The tiller comprises a tiller body that is elongated along a tiller axis between a fixed end and a free end. A throttle grip is disposed on the free end. The throttle grip is rotatable through a first (left handed) range of motion from an idle position in which the outboard motor is controlled at idle speed to first (left handed) wide open throttle position in which the outboard motor is controlled at wide open throttle speed and alternately through a second (right handed) range of motion from the idle position to a second (right handed) wide open throttle position in which the outboard motor is controlled at wide open throttle speed.

U.S. Pat. No. 9,963,213 discloses a system for mounting an outboard motor propulsion unit to a marine vessel transom. The propulsion unit's midsection has an upper end supporting an engine system and a lower end carrying a gear housing. The mounting system includes a support cradle having a head section coupled to a transom bracket, an upper structural support section extending aftward from the head section and along opposite port and starboard sides of the midsection, and a lower structural support section suspended from the upper structural support section and situated on the port and starboard sides of the midsection. A pair of upper mounts couples the upper structural support section to the midsection proximate the engine system. A pair of lower mounts couples the lower structural support section to the midsection proximate the gear housing. At least one of the upper and lower structural support sections comprises an extrusion or a casting.

U.S. Pat. No. 9,969,475 discloses a system for mounting an outboard motor propulsion unit to a marine vessel transom includes a support cradle having a head section coupled to a transom bracket and a pair of arms extending aftward from the head section and along opposite port and starboard sides of the propulsion unit. A pair of upper mounts is provided, each upper mount in the pair coupling a respective arm to the propulsion unit aft of a center of gravity of an engine system of the propulsion unit. A pair of lower mounts is also provided, each lower mount in the pair coupling the propulsion unit to the transom bracket. The pair of upper mounts is located aft of the pair of lower mounts when the propulsion unit is in a neutral position, in which the propulsion unit is generally vertically upright and not tilted or trimmed with respect to the transom.

U.S. Pat. No. 10,124,871 discloses an outboard motor having a mounting assembly, a powerhead, a transmission, and a shift shaft that extends from the powerhead to the transmission via a conduit in the mounting assembly. The shift shaft is positionable into a forward position in which the transmission is engaged in forward gear, reverse position in which the transmission is engaged in reverse gear, and a neutral position in which the transmission is in neutral gear. In the forward position, an upper end of the shift shaft is positioned closer to a forward side of the conduit than the aftward side of the conduit. In the reverse position, the upper end of the shift shaft is positioned closer to an aftward side of the conduit than the forward side of the conduit. In the neutral position, the upper end of the shift shaft is positioned between the forward and reverse positions.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

An outboard motor and apparatuses for mounting an outboard motor on a marine vessel are herein disclosed. The outboard motor extends from top to bottom in an axial direction, from fore to aft in a longitudinal direction that is perpendicular to the axial direction, and from port to starboard in a lateral direction that is perpendicular to the axial direction and perpendicular to the longitudinal direction. The outboard motor includes a powerhead; a driveshaft housing located below the powerhead; a steering arm extending forwardly from the driveshaft housing; a steering tube extending downwardly from the steering arm; an upper mounting device that resiliently mounts the steering arm to the driveshaft housing; and a lower mounting device comprising a yoke that laterally extends from the steering tube, the yoke being clamped to the steering tube and containing port and starboard mounts that resiliently couple the steering tube to the driveshaft housing.

BRIEF DESCRIPTION OF THE DRAWINGS

Examples are described with reference to the following drawing figures. The same numbers are used throughout to reference like features and components.

DETAILED DESCRIPTION

Figure 1:
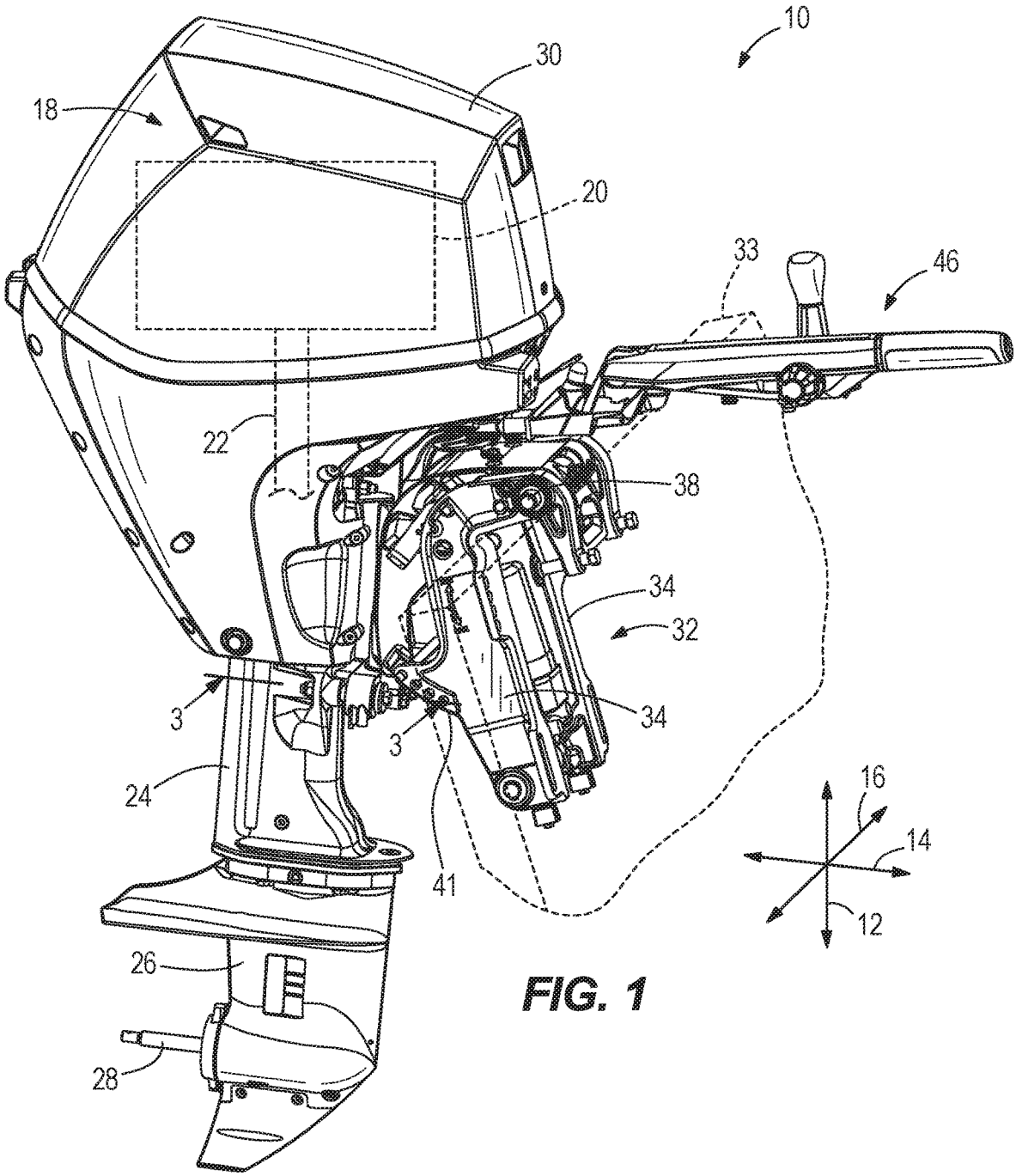
FIG. 1 is a starboard-side perspective view of an outboard motor according to the present disclosure.
Figure 2:
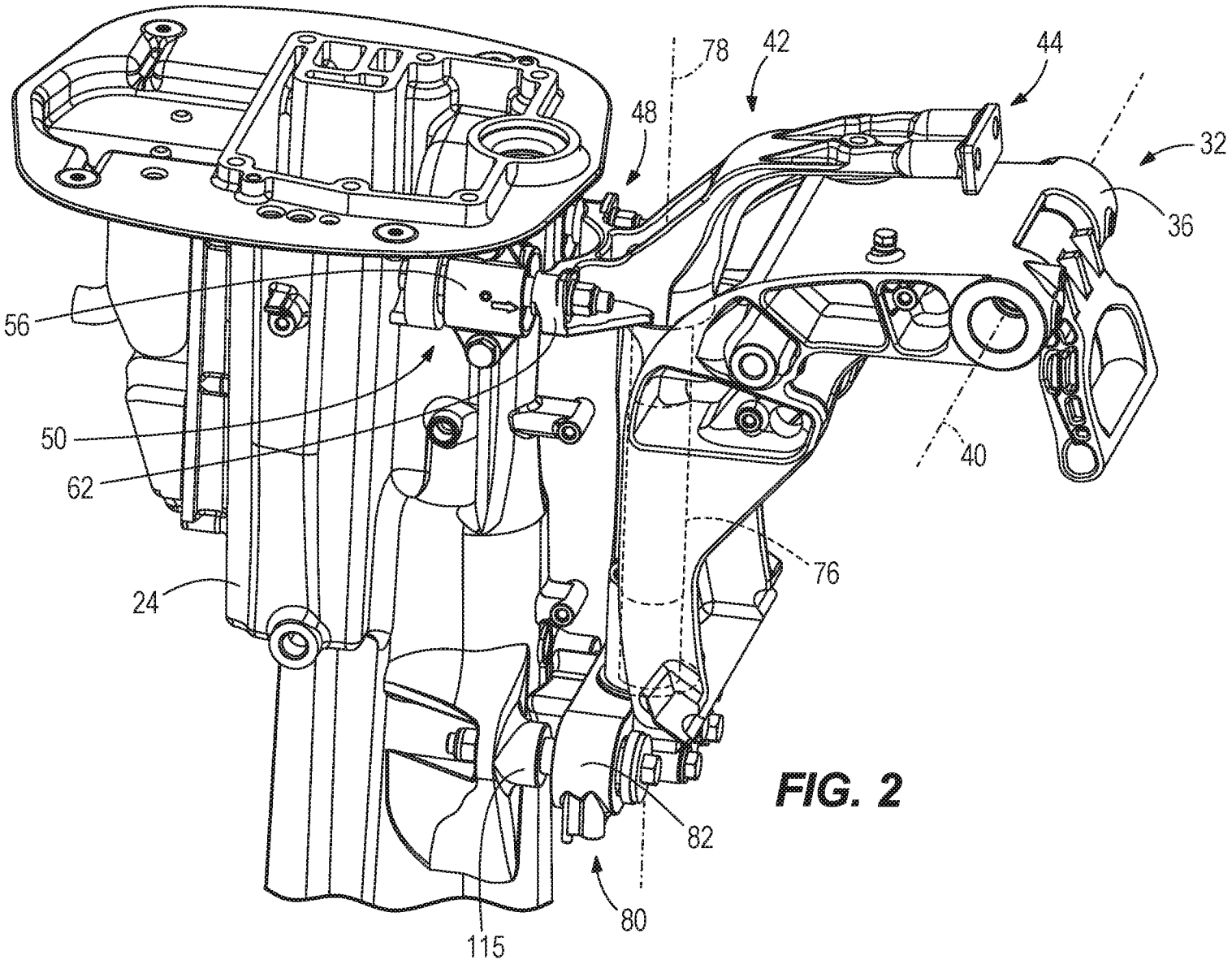
FIG. 2 is a starboard-side view of a driveshaft housing, steering arm, steering tube, and swivel bracket of a transom bracket.

FIGS. 1 and 2 depict an outboard motor 10 configured according to the present disclosure. The outboard motor 10 extends from top to bottom in an axial direction 12, from fore to aft in a longitudinal direction 14 that is perpendicular to the axial direction 12, and from port to starboard in a lateral direction 16 that is perpendicular to the axial direction 12 and perpendicular to the longitudinal direction 14. The outboard motor 10 includes a powerhead 18, which among other things can include a conventional internal combustion engine 20 configured to cause rotation of an axially-elongated driveshaft 22 that extends axially downwardly from the internal combustion engine 20 into a driveshaft housing 24 located below the powerhead 18. A lower gearcase 26 is located below the driveshaft housing 24 and contains conventional bevel gears (not shown), which couple the axially-elongated driveshaft 22 to a longitudinally-elongated propeller shaft 28, such that rotation of the driveshaft 22 causes rotation of the propeller shaft 28. One or more propellers (not shown) are mountable on the propeller shaft 28 and configured to rotate with the propeller shaft 28 to thereby propel a marine vessel in water, all as is conventional. A top cowl 30 is mounted on top of the driveshaft housing 24 and encloses the powerhead 18.

A transom bracket 32 mounts the outboard motor 10 to the transom 33 of the marine vessel. The type and configuration of the transom bracket 32 can vary from what is shown. In the illustrated example, the transom bracket 32 includes a pair of clamp brackets 34 and a swivel bracket 36 located between the clamp brackets 34. The clamp brackets 34 are fixedly coupled to the transom 33, as shown. The swivel bracket 36 is pivotable with respect to the clamp brackets 34 about a pivot shaft 38 that laterally extends through the forward upper ends of the clamp brackets 34, particularly along a trim axis 40. A selector bracket having holes 41 is provided on at least one of the clamp brackets 34. Holes 41 respectively become aligned with a corresponding mounting hole on the swivel bracket 36 at different selectable trim positions for the outboard motor 10. A selector pin (not shown) can be manually inserted into the aligned holes to thereby lock the outboard motor 10 in place with respect to the trim axis 40, all as is conventional.

Figure 4:
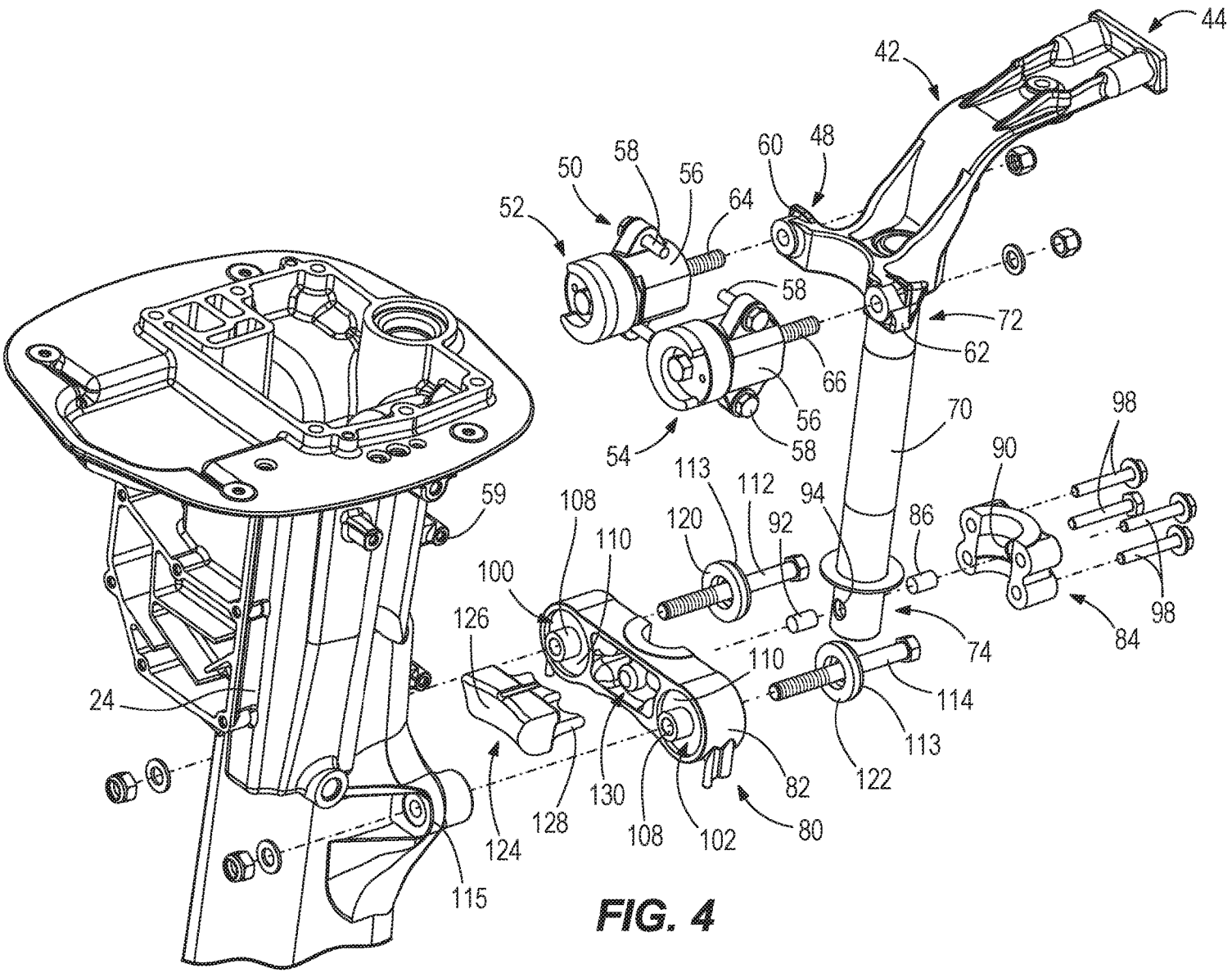
FIG. 4 is a port-side exploded view of components shown in FIG. 2.

Referring to FIGS. 2 and 4, the driveshaft housing 24 is coupled to the swivel bracket 36 such that pivoting of the swivel bracket 36 about the trim axis 40 trims the driveshaft housing 24 and the rest of the outboard motor 10 relative to the marine vessel, for example out of and/or back into the body of water in which the marine vessel is operated. In particular, a steering arm 42 is coupled to and extends forwardly from the driveshaft housing 24, towards the transom 33 of the marine vessel. The steering arm 42 has a forward end 44 that is rigidly connected to a manually operable tiller 46 (see FIG. 1) in a conventional arrangement. The tiller 46 is a conventional item, and the type and configuration of the tiller 46 can vary from what is shown. One example of a suitable tiller 46 is disclosed in the above-incorporated U.S. Pat. No. 9,764,813. Other suitable examples are disclosed in U.S. Pat. Nos. 10,246,173; 9,789,945; and 9,783,278; which are also incorporated herein by reference. Note however that the concepts of the present disclosure are not limited for use with tiller arms, and in fact could be implemented in marine drives having automatic steering systems or any other known apparatus for steering a marine drive with respect to a marine vessel.

The steering arm 42 has an opposite, aftward end 48 that is resiliently coupled to the driveshaft housing 24 by an upper mounting device 50. The type and configuration of the upper mounting device 50 can vary from what is shown. In the illustrated example, the upper mounting device 50 includes port and starboard mounts 52, 54 that each include a generally cylindrical housing 56, a radially inner cylindrical bearing (not shown), and a resilient elastomer element (not shown) disposed radially between the cylindrical housing 56 and the inner cylindrical bearing. The port and starboard mounts 52, 54 are conventional items, examples of which are disclosed in the above-incorporated U.S. Pat. Nos. 9,963,213; 9,701,383; and 9,205,906. The port and starboard mounts 52, 54 are coupled to port and starboard mounting flanges 60, 62 that laterally extend from the aftward end 48 of the steering arm 42. Port and starboard fasteners 64, 66 longitudinally extend through the port and starboard mounting flanges 60, 62 and through the inner cylindrical bearings. Fasteners 58 laterally extend through the mounting flanges on the cylindrical housing 56 and into corresponding laterally-extending mounting bosses 59 on the port and starboard sides of the driveshaft housing 24, thereby resiliently coupling the aftward end 48 of the steering arm 42 to the outboard motor 10.

Referring to FIGS. 2 and 4, a steering tube 70 is fixed to and extends downwardly from the steering arm 42. The steering tube 70 has a top end 72 that is rigidly fixed to the steering arm 42 and an opposite, bottom end 74. The steering tube 70 extends downwardly through a corresponding through-bore 76 in the swivel bracket 36 and is freely rotatable within the through-bore 76 and with respect to the swivel bracket 36. The steering tube 70 thus defines a steering axis 78 about which the outboard motor 10 can be steered, for example via manual operation of the tiller 46, as will be further described herein below.

Figure 3:
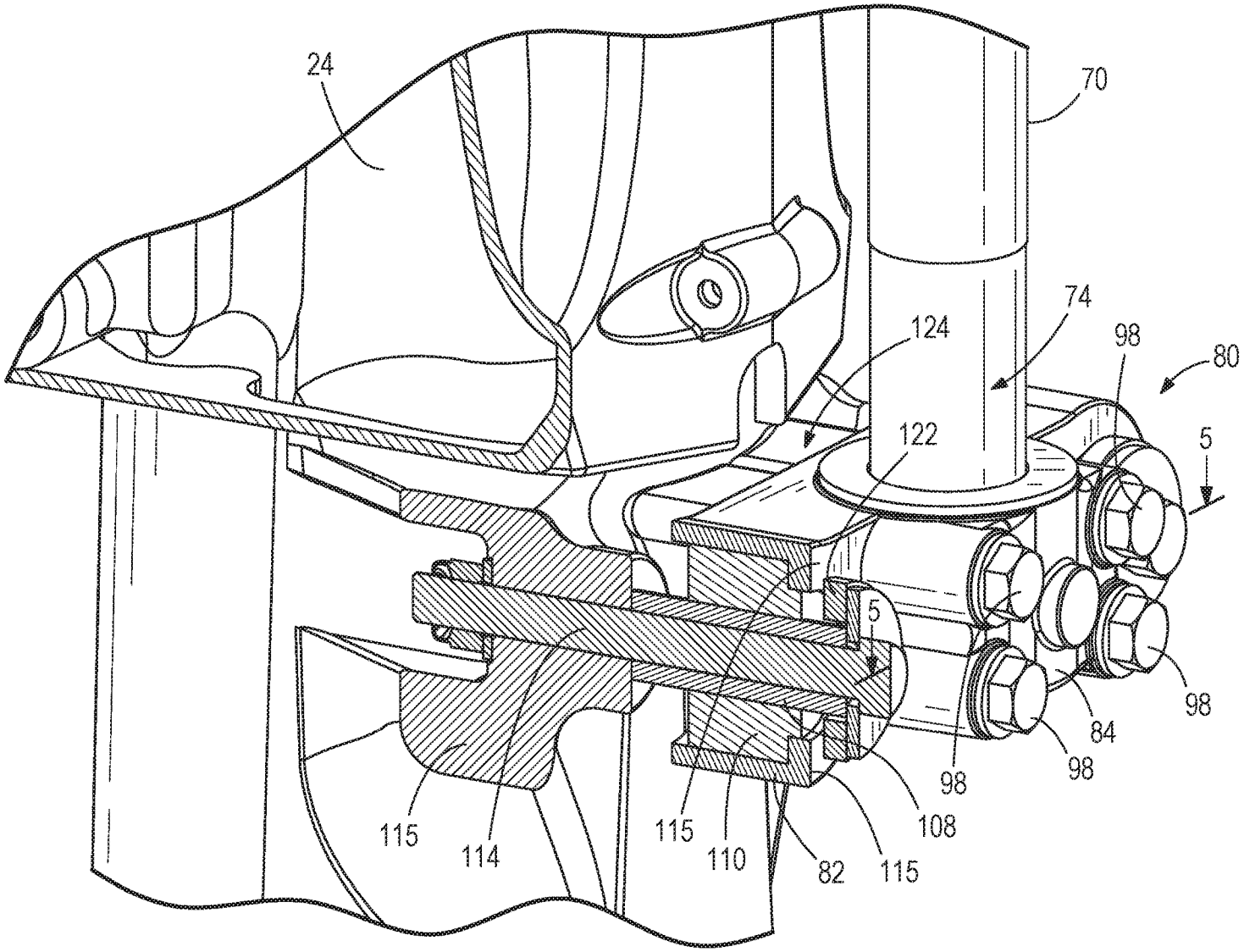
FIG. 3 is a view of section 3-3, taken in FIG. 1.
Figure 5:
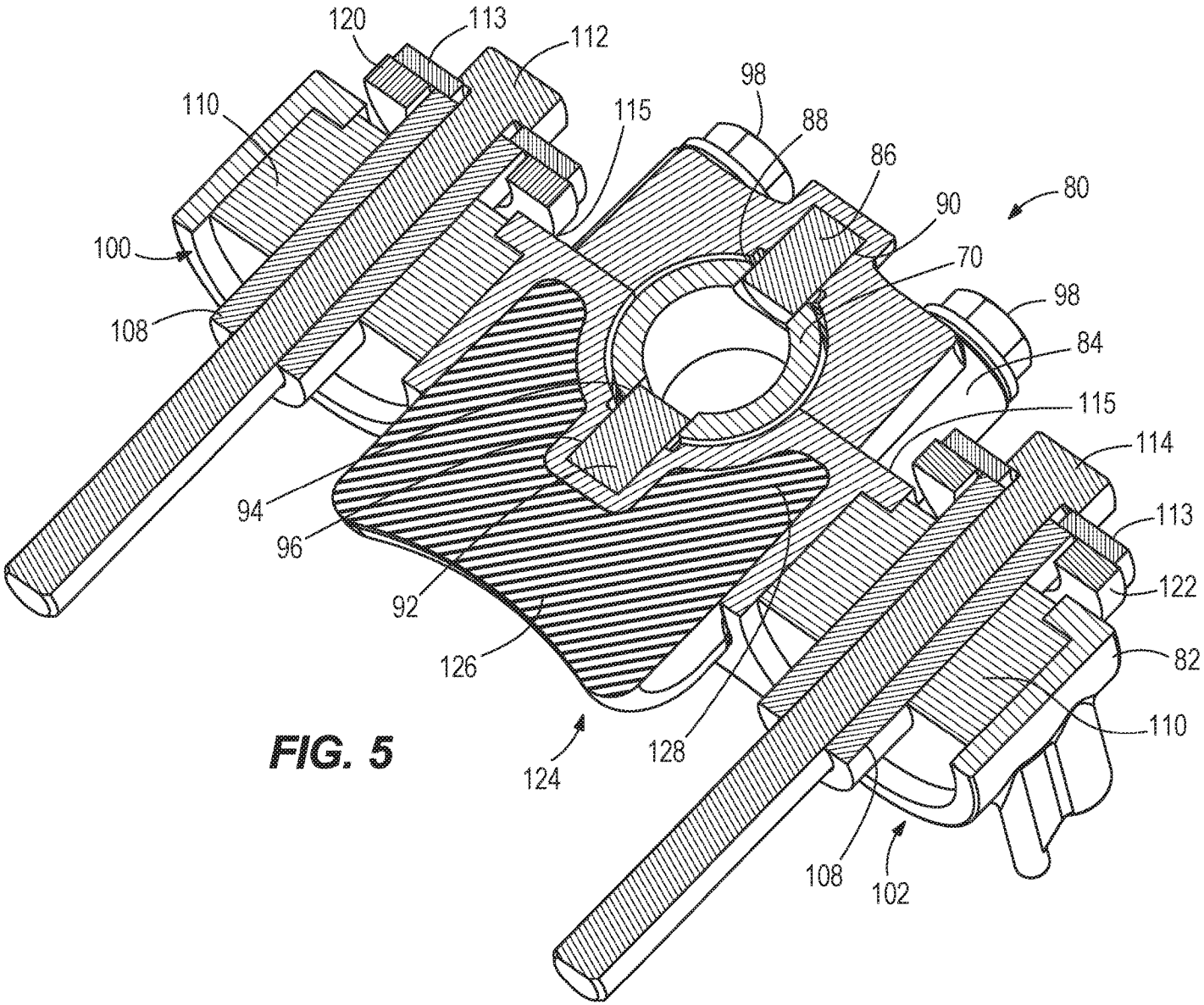
FIG. 5 is a view of section 5-5, taken in FIG. 3.

Referring to FIGS. 3-5, a lower mounting device 80 is a focus of the present disclosure. The lower mounting device 80 resiliently couples the bottom end 74 of the steering tube 70 to the driveshaft housing 24 in an easily serviceable arrangement that efficiently and effectively dampens vibrations between the outboard motor 10 and tiller 46. The lower mounting device 80 is located closer to the bottom end 74 of the steering tube 70 than the top end 72 and includes a yoke 82 that is clamped to the steering tube 70 by a clamping bracket 84. The yoke 82 is located longitudinally between the steering tube 70 and the driveshaft housing 24, and laterally extends from the steering tube 70. A first dowel pin 86 longitudinally extends through a hole 88 in the bottom end 74 of the steering tube 70 and a corresponding hole 90 in the clamping bracket 84 to thereby rotationally lock the clamping bracket 84 with respect to the steering tube 70. A second dowel pin 92 longitudinally extends through a radially opposite hole 94 in the bottom end 74 of the steering tube 70 and a corresponding hole 96 in the yoke 82 to thereby rotationally lock the yoke 82 with respect to the steering tube 70. Four fasteners 98 longitudinally extend through corresponding holes in the clamping bracket 84 and holes in the yoke 82. Tightening the fasteners 98 effectively clamps the clamping bracket 84 and yoke 82 together, sandwiching the steering tube 70 there between. Thus, the lower mounting device 80 is securely clamped onto the bottom end 74 of the steering tube 70. Removal of the fasteners 98 advantageously allows a technician to service and/or replace the lower mounting device 80 without requiring disassembly of the surrounding components, such as the steering tube 70.

The yoke 82 contains port and starboard mounts 100, 102 that resiliently couple the steering tube 70 to the driveshaft housing 24. In particular, the yoke 82 has a port through-bore 104 in which the port mount 100 is located and a starboard through-bore 106 in which the starboard mount 102 is located. Each of the port and starboard mounts 100, 102 has a longitudinally-extending, radially inner cylindrical bearing 108 and a resilient (e.g., elastomer) element 110 disposed radially between the inner cylindrical bearing 108 and respective through-bore 104, 106. Preferably, the resilient (e.g., elastomer) element 110 of the port and starboard mounts 100, 102 is adhered (bonded) to the radially inner surfaces 111 of the port and starboard through-bores 104, 106 for example by an adhesive. Port and starboard fasteners 112, 114 longitudinally extend through the inner cylindrical bearings 108 of the port and starboard mounts 100, 102 and into corresponding longitudinally-oriented port and starboard mounting flanges 116, 118 on the driveshaft housing 24. Resilient (e.g., elastomer) washers 120, 122 are located on the port and starboard fasteners 112, 114 and are clamped (sandwiched) between metal washers 113 and the heads of the respective fasteners 112, 114, and forward outer surface flanges 115 on the yoke 82.

Figure 6:
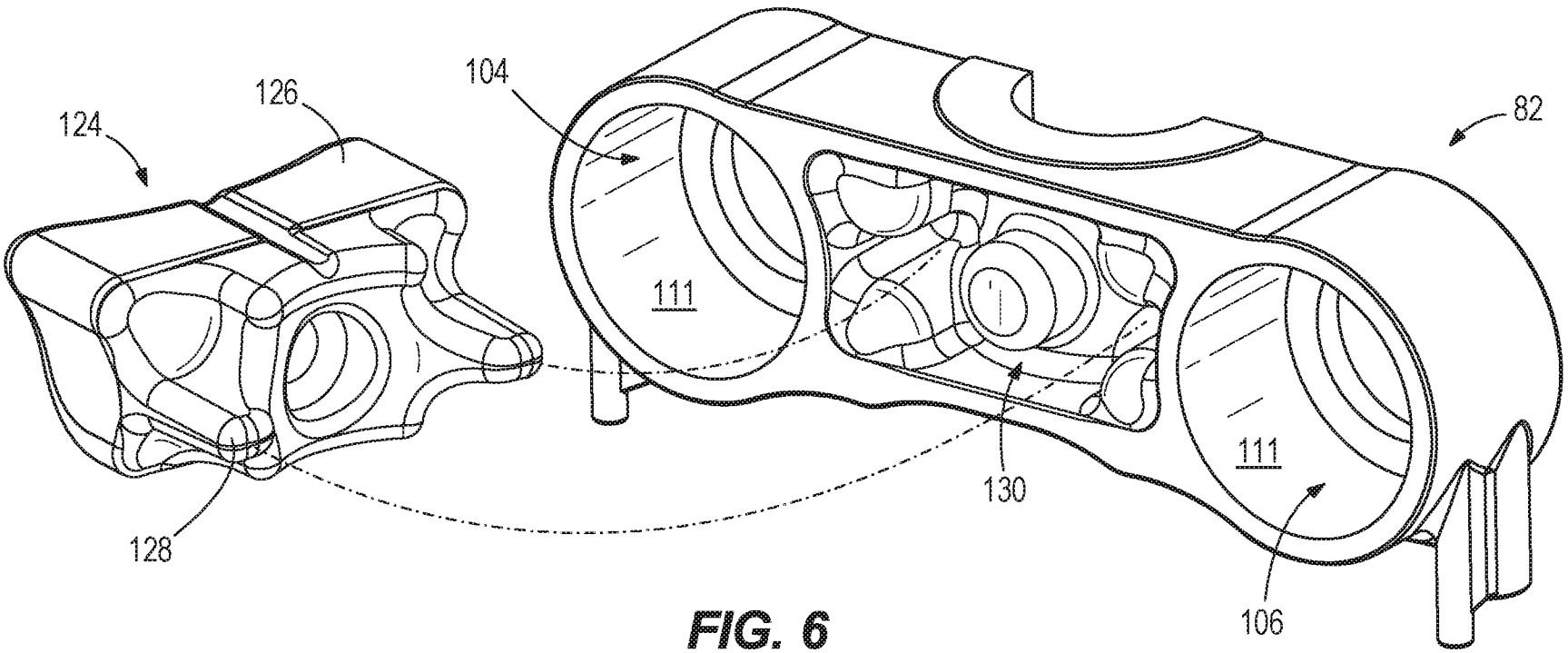
FIG. 6 is an exploded view of components shown in FIG. 5.

Referring to FIGS. 5 and 6, an elastomer, resilient bumper 124 is mounted onto the yoke 82, laterally between the port and starboard mounts 100, 102. The resilient bumper 124 has a body 126 and a tongue 128 that longitudinally extends into engagement with a corresponding recess 130 in the yoke 82. Referring to FIG. 2, the body 126 of the bumper 124 faces and at times abuts the forward exterior surface of the driveshaft housing 24, thus cushioning relative movements between the steering tube 70 and the driveshaft housing 24, protecting these components from collision and thus damage.

In use, the outboard motor 10 is steered via the tiller 46, steering arm 42 and steering tube 70. In particular, a captain of the marine vessel manually grasps and pivots the tiller 46 in either of the port or starboard directions. Pivoting of the tiller 46 pivots the forward end 44 of the rigidly connected steering arm 42, which in turn rotates the steering tube 70 within the through-bore 76 in the swivel bracket 36. Pivoting of the forward end 44 of the steering arm 42 causes commensurate pivoting of the aftward end 48 of the steering arm 42, which is resiliently coupled to the driveshaft housing 24 via the upper mounting device 50. Pivoting of the steering arm 42 also causes rotation of the steering tube 70, which is resiliently coupled at its bottom end 74 to the driveshaft housing 24 via the lower mounting device 80. Thus pivoting of the steering arm 42 causes steering movement of the outboard motor 10 about the steering axis 78, including the powerhead 18, driveshaft housing 24, lower gearcase 26, etc.

Advantageously, the resilient port and starboard mounts 52, 54 and the resilient port and starboard mounts 100, 102 dampen vibrations between the outboard motor 10 and transom 33, thus providing a smoother and more enjoyable operation by the captain. Through research and experimentation, the present inventors determined that the presently disclosed mounting apparatus, and particularly the above-described binocular configuration of the lower mounting device 80, being coupled to both the driveshaft housing 24 and clamped to the bottom end 74 of the steering tube 70 advantageously achieves desired engine vibration isolation and steering control. The present inventors conceived of the presently disclosed configuration, which accomplishes these objectives in a compact and easy to service package, without requiring, for example, removal of the steering tube 70 or other components of the outboard motor 10 from the transom bracket 32.

In the present description, certain terms have been used for brevity, clearness and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. An outboard motor extending from top to bottom in an axial direction, from fore to aft in a longitudinal direction perpendicular to the axial direction, and from port to starboard in a lateral direction perpendicular to the axial direction and perpendicular to the longitudinal direction, the outboard motor comprising:

a powerhead;

a driveshaft housing located below the powerhead;

a steering arm extending forwardly from the driveshaft housing;

a steering tube extending downwardly from the steering arm;

an upper mounting device that resiliently mounts the steering arm to the driveshaft housing;

a lower mounting device comprising a yoke that laterally extends from the steering tube, the yoke containing port and starboard mounts that resiliently couple the steering tube to the driveshaft housing; and a clamping bracket that clamps the yoke to the steering tube, wherein the steering tube is clamped between the clamping bracket and the yoke, and further comprising a pin that rotationally locks the yoke and clamping bracket relative to the steering tube; wherein the lower mounting device is removable from the steering tube by unclamping the yoke and clamping bracket.

2. The outboard motor according to claim 1, wherein the steering tube extends from a top end to a bottom end along a steering axis about which the outboard motor is steerable, and wherein the lower mounting device is located closer to the bottom end of the steering tube than to the top end of the steering tube.

3. The outboard motor according to claim 1, wherein the yoke is located longitudinally between the steering tube and the driveshaft housing.

4. An outboard motor extending from top to bottom in an axial direction, from fore to aft in a longitudinal direction perpendicular to the axial direction, and from port to starboard in a lateral direction perpendicular to the axial direction and perpendicular to the longitudinal direction, the outboard motor comprising:

a powerhead;

a driveshaft housing located below the powerhead;

a steering arm extending forwardly from the driveshaft housing;

a steering tube extending downwardly from the steering arm;

an upper mounting device that resiliently mounts the steering arm to the driveshaft housing;

a lower mounting device comprising a yoke that laterally extends from the steering tube, the yoke being clamped to the steering tube and containing port and starboard mounts that resiliently couple the steering tube to the driveshaft housing;

wherein the yoke is located longitudinally between the steering tube and the driveshaft housing, and a resilient bumper located longitudinally between the yoke and the driveshaft housing and laterally between the port and starboard mounts, the resilient bumper cushioning relative movements between the steering tube and the driveshaft housing.

5. The outboard motor according to claim 4, further comprising a clamping bracket that clamps the yoke to the steering tube.

6. The outboard motor according to claim 5, wherein the steering tube is clamped between the clamping bracket and the yoke.

7. The outboard motor according to claim 6, further comprising port and starboard fasteners that longitudinally extend through a respective one of the port and starboard mounts and through a respective one of port and starboard mounting flanges on the driveshaft housing.

8. An outboard motor extending from top to bottom in an axial direction, from fore to aft in a longitudinal direction perpendicular to the axial direction, and from port to starboard in a lateral direction perpendicular to the axial direction and perpendicular to the longitudinal direction, the outboard motor comprising:

a powerhead;

a driveshaft housing located below the powerhead;

a steering arm extending forwardly from the driveshaft housing;

a steering tube extending downwardly from the steering arm;

an upper mounting device that resiliently mounts the steering arm to the driveshaft housing;

a lower mounting device comprising a yoke that laterally extends from the steering tube, the yoke being clamped to the steering tube and containing port and starboard mounts that resiliently couple the steering tube to the driveshaft housing;

a clamping bracket that clamps the yoke to the steering tube, wherein the steering tube is clamped between the clamping bracket and the yoke;

port and starboard fasteners that longitudinally extend through a respective one of the port and starboard mounts and through a respective one of port and starboard mounting flanges on the driveshaft housing; and resilient washers on the port and starboard fasteners, respectively, the resilient washers being sandwiched between the port and starboard fasteners and the port and starboard mounts.

9. An outboard motor extending from top to bottom in an axial direction, from fore to aft in a longitudinal direction perpendicular to the axial direction, and from port to starboard in a lateral direction perpendicular to the axial direction and perpendicular to the longitudinal direction, the outboard motor comprising:

a powerhead;

a driveshaft housing located below the powerhead;

a steering arm extending forwardly from the driveshaft housing;

a steering tube extending downwardly from the steering arm;

an upper mounting device that resiliently mounts the steering arm to the driveshaft housing;

a lower mounting device comprising a yoke that laterally extends from the steering tube, the yoke being clamped to the steering tube and containing port and starboard mounts that resiliently couple the steering tube to the driveshaft housing;

a clamping bracket that clamps the yoke to the steering tube, wherein the steering tube is clamped between the clamping bracket and the yoke;

port and starboard fasteners that longitudinally extend through a respective one of the port and starboard mounts and through a respective one of port and starboard mounting flanges on the driveshaft housing; and a resilient bumper located longitudinally between the yoke and the driveshaft housing and laterally between the port and starboard mounts, the resilient bumper cushioning relative movements between the steering tube and the driveshaft housing.

10. The outboard motor according to claim 8, further comprising a dowel pin that rotationally locks at least one of the yoke and clamping bracket with respect to the steering tube.

11. The outboard motor according to claim 10, wherein the dowel pin is a first longitudinally-extending dowel pin that rotationally locks the yoke with respect to the steering tube and further comprising a second longitudinally-extending dowel pin that rotationally locks the clamping bracket with respect to the steering tube.

12. An outboard motor extending from top to bottom in an axial direction, from fore to aft in a longitudinal direction perpendicular to the axial direction, and from port to starboard in a lateral direction perpendicular to the axial direction and perpendicular to the longitudinal direction, the outboard motor comprising:

a powerhead;

a driveshaft housing located below the powerhead;

a steering arm extending forwardly from the driveshaft housing;

a steering tube extending downwardly from the steering arm;

an upper mounting device that resiliently mounts the steering arm to the driveshaft housing; and a lower mounting device comprising a yoke that laterally extends from the steering tube, the yoke being clamped to the steering tube and containing port and starboard mounts that resiliently couple the steering tube to the driveshaft housing;

wherein the yoke comprises a port through-bore in which the port mount is disposed and a starboard through-bore in which the starboard mount is disposed, and wherein the port and starboard mounts are adhered to the port and starboard through-bores, respectively, by adhesive.

13. The outboard motor according to claim 12, further comprising a clamping bracket that clamps the yoke to the steering tube.

14. The outboard motor according to claim 12, further comprising port and starboard fasteners that longitudinally extend through a respective one of the port and starboard mounts and through a respective one of port and starboard mounting flanges on the driveshaft housing.

15. The outboard motor according to claim 14, further comprising resilient washers on the port and starboard fasteners, respectively, the resilient washers being sandwiched between the port and starboard fasteners and the port and starboard mounts.

16. The outboard motor according to claim 14, further comprising a resilient bumper located longitudinally between the yoke and the driveshaft housing and laterally between the port and starboard mounts, the resilient bumper cushioning relative movements between the steering tube and the driveshaft housing.

17. The outboard motor according to claim 16, wherein the resilient bumper comprises a body and a tongue that longitudinally extends into engagement with a recess in the yoke, located laterally between the port and starboard mounts.

18. The outboard motor according to claim 1, wherein the upper mounting device comprises port and starboard mounts that couple the steering arm to port and starboard sides of the driveshaft housing.

19. An outboard motor extending from top to bottom in an axial direction, from fore to aft in a longitudinal direction perpendicular to the axial direction, and from port to starboard in a lateral direction perpendicular to the axial direction and perpendicular to the longitudinal direction, the outboard motor comprising:

a powerhead;

a driveshaft housing located below the powerhead;

a steering arm extending forwardly from the driveshaft housing;

a steering tube extending downwardly from the steering arm;

an upper mounting device that resiliently mounts the steering arm to the driveshaft housing;

a lower mounting device comprising a yoke that laterally extends from the steering tube, the yoke being clamped to the steering tube and containing port and starboard mounts that resiliently couple the steering tube to the driveshaft housing;

wherein the upper mounting device comprises port and starboard mounts that couple the steering arm to port and starboard sides of the driveshaft housing; and port and starboard mounting flanges on the steering arm and fasteners that longitudinally extend, respectively, through the port and starboard mounting flanges, through the port and starboard mounts and into the port and starboard sides of the driveshaft housing.

20. The outboard motor according to claim 19, wherein the port and starboard mounting flanges extend from the aftward end of the steering arm.

* * * * *